US006453996B1

(12) United States Patent
Carmichael et al.

(10) Patent No.: US 6,453,996 B1
(45) Date of Patent: Sep. 24, 2002

(54) APPARATUS INCORPORATING JET PUMP FOR WELL HEAD CLEANING

(75) Inventors: Mark Carmichael, Jersey; Paul Howlett; George Telfer, both of Aberdeen, all of (GB)

(73) Assignee: SPS-AFOS Group Limited, Aberdeen (GB)

( * ) Notice: Subject to any disclaimer, the term of this patent is extended or adjusted under 35 U.S.C. 154(b) by 0 days.

(21) Appl. No.: 09/667,933

(22) Filed: Sep. 22, 2000

(30) Foreign Application Priority Data

Sep. 22, 1999 (GB) ..... 9922378

(51) Int. Cl.[7] ..... E21B 37/00

(52) U.S. Cl. ..... 166/177.3; 166/222; 166/312

(58) Field of Search ..... 166/99, 105.1, 166/177.3, 311, 312, 222, 223; 15/104.03, 104.05, 104.061; 134/22.12, 24, 166 C, 167 C, 172, 198

(56) References Cited

U.S. PATENT DOCUMENTS

| | | | | | |
|---|---|---|---|---|---|
| 3,310,113 | A | * | 3/1967 | Maness | 166/173 |
| 3,720,264 | A | * | 3/1973 | Hutchison | 166/311 |
| 4,216,738 | A | * | 8/1980 | Muta | 118/72 |
| 4,285,638 | A | * | 8/1981 | Clark | 417/172 |
| 4,441,557 | A | * | 4/1984 | Zublin | 166/312 |
| 4,504,195 | A | * | 3/1985 | Binks et al. | 417/172 |
| 4,744,420 | A | * | 5/1988 | Patterson et al. | 166/312 |
| 4,790,376 | A | * | 12/1988 | Weeks | 166/68 |
| 4,919,204 | A | * | 4/1990 | Baker et al. | 166/223 |
| 5,033,545 | A | | 7/1991 | Sudol | |
| 5,086,842 | A | | 2/1992 | Cholet | |
| 5,158,140 | A | * | 10/1992 | Ferry | 166/312 |
| 6,065,541 | A | * | 5/2000 | Allen | 166/318 |
| 6,170,557 | B1 | * | 1/2001 | Noles, Jr. et al. | 166/312 |
| 6,199,566 | B1 | * | 3/2001 | Gazewood | 134/166 |
| 6,302,201 | B1 | * | 10/2001 | Elliott | 166/173 |

FOREIGN PATENT DOCUMENTS

| | | | | | |
|---|---|---|---|---|---|
| GB | 2354272 | A | * | 3/2001 | E21B/37/00 |

* cited by examiner

*Primary Examiner*—David Bagnell
*Assistant Examiner*—Jennifer H. Gay
(74) *Attorney, Agent, or Firm*—Clifford W. Browning; Woodard, Emhardt, Naughton, Moriarty & McNett

(57) ABSTRACT

A cleanup tool is described for use in a wellbore, the tool having a body which defines flow passages which communicate with the venturi chamber, the venturi chamber itself communicating with a discharge passage for radially or near radially discharging jetted fluid for cleaning a well head or the like. The tool may further include or be associated with filtration devices, including a junk basket or filter screen.

12 Claims, 3 Drawing Sheets

APPARATUS INCORPORATING JET PUMP FOR WELL HEAD CLEANING

This invention relates to well cleaning apparatus and finds a particular application in the cleaning of stepped regions of well bores such as the well head.

Bore holes are typically lined with a concrete casing. In order to maximise production from the well it is necessary to clean out the casing, removing debris and contaminants.

One region of the bore hole which is particularly hard to clean is the well head. The well head is stepped in diameter, with a larger diameter at the top. Due to this stepped profile, tools adapted to clean the main body of the bore hole with brushes or jets of cleaning fluid will not be of the correct diameter to efficiently clean the upper steps. At the present time, the stepped profile of the well head is generally not sufficiently cleaned in consequence to a lack of satisfactory equipment. It is recognised in the present invention that the more efficient cleaning of this stepped region of the well head would significantly improve fluid flow in that area and so have benefits for production.

In the art it is known to jet well fluid against the well casing to perform a cleaning function. Tools adapted for this purpose are often called circulation tools. Such tools typically have a body member with an axial bore therethrough to permit circulation and one or more fluid ports which extend radially through side walls of the body member. Means are provided for controlling the flow path of fluid between a path running axially through the tool and a path leading to the radial outlets.

However, as discussed above, in the past such tools have been designed with tool bodies of a constant outer diameter and therefore have not been suitably adapted for use in well head cleaning.

Moreover, circulation tools used in well bore cleaning known heretofore are limited by the pressure head of fluid pumped through the tool. Typically, circulation tools are adapted to be connected to a work string or the like and thus their ability to jet fluid in a radial direction against the inside casing wall is affected by the pressure and volume of fluid pumped through the string.

It will be appreciated by those skilled in the art that it would be advantageous if the pressure and/or velocity of expelled fluid through radial outlets could be increased without the need to make increased demands on the pumping equipment.

It is therefore a further object of the present invention to provide a greater capacity or ability to meet these advantages and overcome or mitigate any aforementioned disadvantages associated with the prior art.

According to the present invention there is provided a clean up tool for use in a well bore, the tool comprising a tool body defining a first and second liquid passage which each communicate with a venturi chamber, wherein the first and second liquid passages are each associated with an inlet for receiving well fluid into the tool, wherein the tool body further comprises a discharge passage associated with one or more outlets, wherein the discharge passage also physically communicates with the venturi chamber and is adapted to allow the expulsion of fluid out of the tool body in a radial or near radial direction.

Preferably, the tool further includes means for providing a third liquid passage and a filter means, wherein the third liquid passage is adapted to direct the flow of well fluid located in an annulus or space between the tool body and the well casing or well head toward and subsequently through said filter means.

Typically, the tool body is shaped and sized such that it is provided with a stepped outer profile which corresponds to the internal diameters of a well head, but so as to leave a space between the outer circumference of the tool body and the internal surface of the well head, wherein the space provides at least part of said third fluid passage.

The tool may include or be associated with a seal or barrier that prevents the flow of well fluid in the third fluid passage from bypassing the filter means.

The filter means may be provided in the form of a conventional junk basket. Alternatively, the filter means may be a screen.

Preferably, the inlet associated with the second fluid passage is positioned so as to only receive fluid that has been filtered through said filter means.

The discharge passage may also be provided with or associated with a further outlet, the further outlet being provided to allow well fluid to be circulated above the tool to surface.

Typically, the first fluid passage would incorporate a nozzle for creating a venturi in the vicinity of the venturi chamber.

The radial or near radial outlets associated with the discharge passage may also be provided with respective nozzles in order to provide for the jetting of fluid with appropriate velocity or force.

Preferably the radial outlets are adapted to direct the expelled fluid in a direction between the radial and axial axes, wherein the direction is chosen to optimise the ability of the expelled fluid to access or penetrate the various recesses in the well head or casing.

There may be two outlets positioned to work in tandem on a recess provided in the well head, wherein each outlet is adapted to expel fluid in a different direction from the other.

An example embodiment of the present invention will now be described with reference to the following drawings in which.

Figure 1:
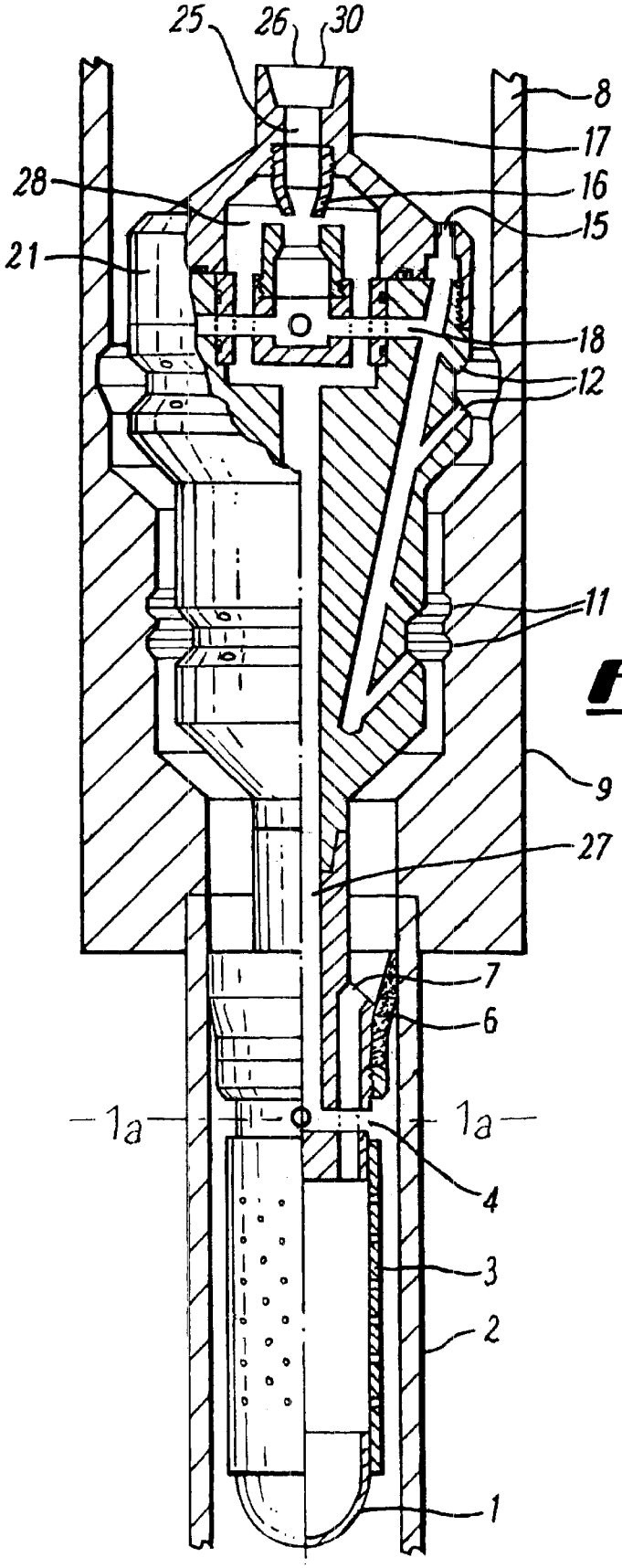
FIG. 1 illustrates a tool combined with a junk bonnet or catcher in half sectional elevation.
Figure 1A:
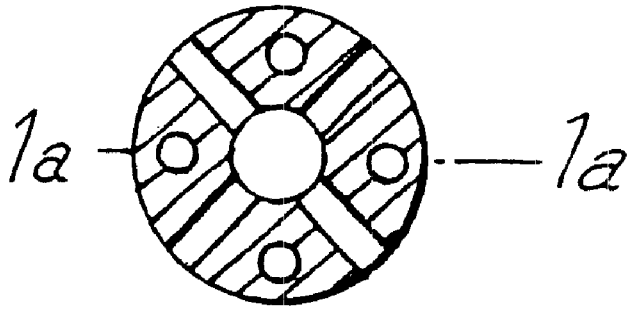
FIG. 1*a* is a cross-sectional view taken along line 1*a*—1*a* in FIG. 1.
Figure 2A:
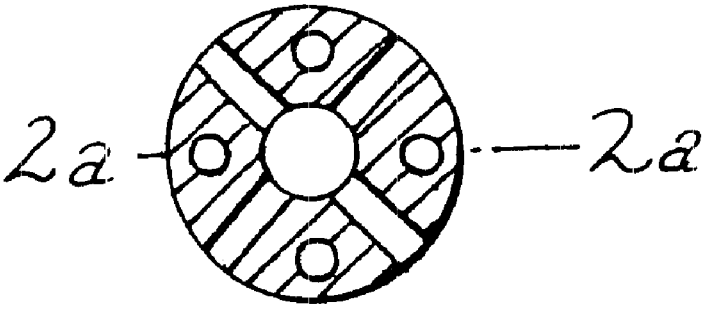
FIG. 2 depicts the embodiment of FIG. 1 on which fluid flow directions are demonstrated with arrows.
Figure 2:
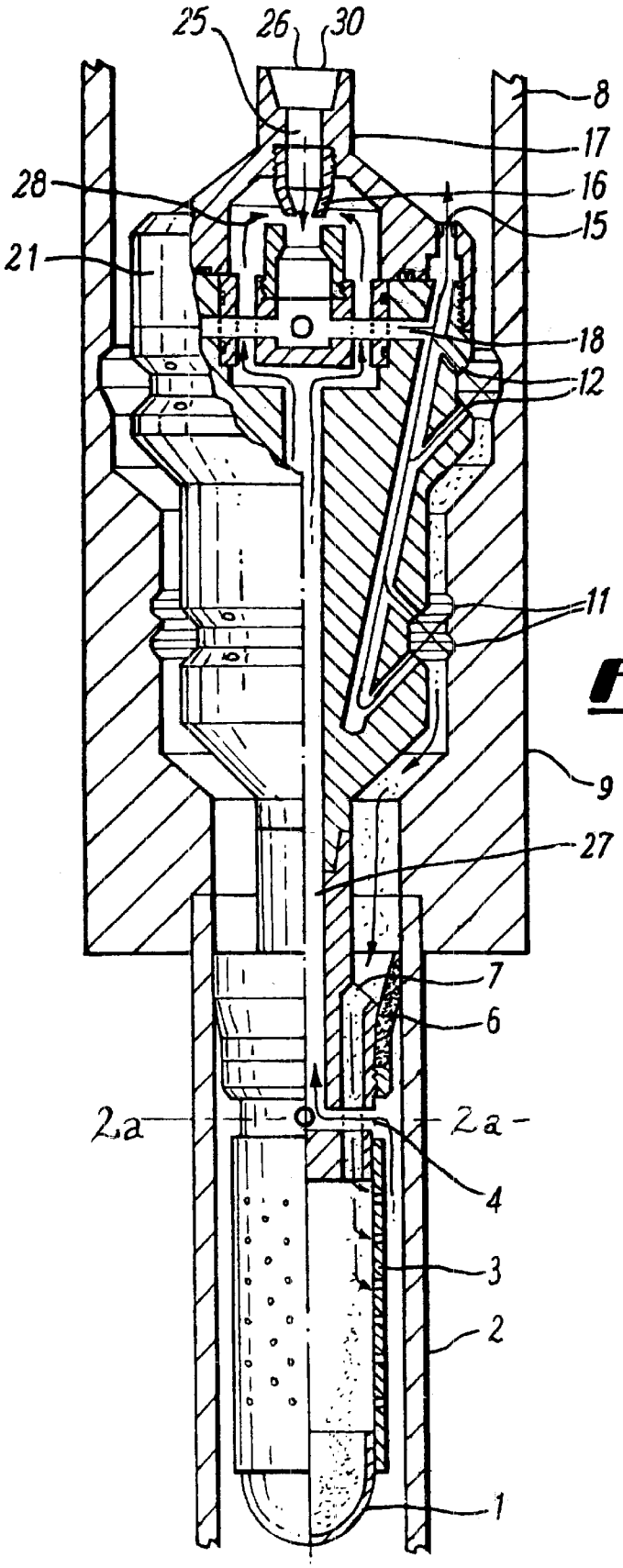

FIG. 2*a* is a cross-sectional view taken along line 2*a*—2*a* in FIG. 2.

With reference to the drawings, there is shown in half sectional elevation a clean up tool for use in a bore hole well-head 9. The well head 9 is shown as having two steps in its diameter, thereby having three different diameters. Additionally, each section of the well head 9 is associated with various recesses or irregularities 11, which in the past have been problematic to clean.

The clean up tool is adapted for connection to a pipe string (not shown) or the like by means of the box connection 30 located at the top of the tool body 17. The pipe string would allow the tool to be lowered down a riser 8 and suitably positioned to allow the tool to clean the well head. Accordingly, the tool 21 is adapted to move and rotate with pipe string. It will be appreciated however by those skilled in the art that the present invention is not limited to use with a pipe string and a tool falling within the scope of the invention may be suspended by coiled tubing or other means.

It will also be noted from the example embodiment shown in the drawings that the tool body 17 defines various fluid passages. A first fluid passage 25 is provided via the inlet 26 at the box connection 30 and through an axial bore communicating with a nozzle 16. The nozzle 16 is adapted to expel fluid into the venturi chamber 28.

A second fluid passage 27 provides for the flow of fluid through an inlet 4 located toward the lower end of the tool which communicates with an axial bore running substantially through the tool body 17 until reaching the venturi chamber 28. Thus it will be seen that the first and second fluid passages come together at this chamber 28.

The tool body 17 yet further defines a discharge channel 18 which provides for the flow of well fluid from the chamber 28 to various jet port outlets 12 strategically positioned in juxtaposition to the recesses 11. As will be seen in this example embodiment, the outlet ports 12 are angled between a completely radial and completely axial direction in order to optimise the direction of fluid flow for cleaning purposes. In the embodiment illustrated, several such outlet ports 12 are positioned around 2 imaginary circumferential lines around the tool body 17.

In yet further or third fluid path 23 is provided in the annulus or space between the tool body 17 and the internal walls of the well head 9. Well fluid jetted through the ports 12 is therefore able and, in use, will travel downwardly relative to the tool body until it reaches an inlet port 7 whereby it re-enters the tool body 17 and communicates with a filter means 3. In the example embodiment, the filter means 3 is shown as a junk basket and these are well known in the art. The present invention is not limited to any particular form or type of junk basket or, more generally filter means. Nevertheless, the drawings depict a preferred embodiment whereby fluid jetted onto the well head 9 is filtered before being reprocessed through the second fluid passage 27 whereupon it may once again be used as a cleaning jet impacting on the well head wall.

A resilient cup 6 provides a seal between the tool 21 and the well bore casing 2. Notably, the cup 6 is positioned below the inlet port 7 and serves to ensure that fluid travelling in the third passage between the tool body 17 and the well head 9 is directed into the inlet 7. Similarly, the cup seal 6 prevents the flow of filtered fluid upwardly into the annulus between the tool body 17 and well head 9 and, rather, ensures that the filtered fluid passes through the inlet 4 and into thereby the second fluid passage.

A bull nose 1 is provided to cap the lower end of the filter means 3.

Those skilled in the art will appreciate that the invention therefore provides for a venturi effect encouraging a maximum or optimum amount of flow through the outlet ports 12. The nozzle 16 converts power fluid at high pressure and low velocity to low pressure high velocity. The pressure at the entrance of the chamber 28 becomes lower as the power fluid rate is increased. As the pressure drops, additional fluid is caused to be sucked into the second fluid passage 27. The suction fluid becomes entrained with the high velocity jet and then a pumping action begins. After mixing in the throat of the chamber, the combined fluids received via the first and second fluid passages are slowed down by the chamber which acts as a diffuser, thereby once again increasing the fluid pressure to a sufficient extent as to allow fluid to be pumped out the discharge passage through the jet outlets 12 and the outlet 15.

Further modifications and improvements may be incorporated without departing from the scope of the invention herein intended.

We claim:

1. A clean up tool for use in a well bore, the tool comprising a tool body defining a first and second liquid passage which each communicate with a venturi chamber, wherein the first and second liquid passages are each associated with an inlet for receiving well fluid into the tool, wherein the tool body further comprises a discharge passage associated with one or more outlets, wherein the discharge passage also physically communicates with the venturi chamber and is adapted to allow the expulsion of fluid from the chamber out of the tool body through one or more outlets in a radial or near radial direction.

2. A tool as claimed in claim 1 further including a third liquid passage and a filter means, wherein the third liquid passage is adapted to direct the flow of well fluid located in an annulus or space between the tool body and the well casing or well head toward and subsequently through said filter means.

3. A tool as claimed in claim 2 wherein the tool body is shaped and sized such that it is provided with a stepped outer profile which corresponds to the internal diameters of a well head, but so as to leave a space between the outer circumference of the tool body and the internal surface of the well head, wherein the space provides at least part of said third fluid passage.

4. A tool as claimed in claim 2 including or associated with a seal or barrier that prevents the flow of the flow of the well fluid in the third fluid passage from bypassing the filter means.

5. A tool as claimed in claim 2 wherein the filter means is provided in the form of a conventional junk basket.

6. A tool as claimed in claim 2 wherein the filter means is a screen.

7. A tool as claimed in claim 2 wherein the inlet associated with the second fluid passage is positioned so as to only receive fluid that has been filtered through said filter means.

8. A tool as claimed in claim 1 wherein the discharge passage is provided with or associated with a further outlet, the further outlet being provided to allow well fluid to be circulated above the tool to surface.

9. A tool as claimed in claim 1 wherein the first fluid passage incorporates a nozzle for creating a venturi in the vicinity of the venturi chamber.

10. A tool as claimed in claim 1, wherein the one or more radial or near radial outlets associated with the discharge passage are provided with respective nozzles in order to provide for the jetting of fluid with appropriate velocity or force.

11. A tool as claimed in claim 1, wherein the one or more radial outlets are adapted to direct the expelled fluid in a direction between the radial and axial axes, wherein the direction is chosen to optimise the ability of the expelled fluid to access or penetrate the various recesses in the well head or casing.

12. A tool as claimed in claim 1 comprising two said outlets positioned to work in tandem on a recess provided in the well head, wherein each outlet is adapted to expel fluid in a different direction from the other.

* * * * *